US005842631A

United States Patent [19]

Berger

[11] Patent Number: 5,842,631

[45] Date of Patent: Dec. 1, 1998

[54] CONDIMENT COMPARTMENT FOR QUICK SCOOP FOOD CARTONS

[76] Inventor: Cheryl Berger, 621 Overlook Dr., Stuart, Fla. 34994

[21] Appl. No.: 74,747

[22] Filed: May 8, 1998

[51] Int. Cl.[6] ..... B65D 5/48

[52] U.S. Cl. ..... 229/120.13; 229/120.18; 229/120.38; 229/904; 229/906; 493/90; 493/162; 493/912

[58] Field of Search ..... 229/120.02, 120.18, 229/120.38, 400, 902, 904, 906, 120.13; 426/115, 120; 220/23.83; 493/90, 128, 162, 379, 912

[56] References Cited

U.S. PATENT DOCUMENTS

| | | | |
|---|---|---|---|
| D. 370,412 | 6/1996 | Rohrer | D9/347 |
| D. 373,081 | 8/1996 | Bridger | D9/430 |
| D. 376,311 | 12/1996 | Burton | D9/347 |
| 3,442,435 | 5/1969 | Ludder et al. | 229/904 |
| 4,126,261 | 11/1978 | Cook | 229/904 |
| 4,854,466 | 8/1989 | Lane, Jr. | 220/23.83 |
| 4,955,528 | 9/1990 | Schluckebier | 229/120.18 |
| 5,417,364 | 5/1995 | Shaw | 229/904 |
| 5,540,333 | 7/1996 | Gonzalez et al. | 229/400 |
| 5,626,283 | 5/1997 | Mellon | 229/400 |
| 5,630,544 | 5/1997 | Shane | 229/906 |
| 5,720,429 | 2/1998 | Cordle | 229/120.18 |

*Primary Examiner*—Gary E. Elkins
*Attorney, Agent, or Firm*—Kevin Redmond

[57] ABSTRACT

A compartment which is designed to be mounted on the front panel of a quick scoop carton to hold condiments. The compartment facilitates the application of condiments to food by holding condiments that are difficult to handle such as ketchup. The condiment in the compartment and the food in the carton are held by one hand, freeing the other hand to pick up and dip the food in the condiment. This design eliminates the need to squeeze out the condiment from a package and spread it over the food, making the food difficult and messy to handle.

8 Claims, 3 Drawing Sheets

PRIOR ART

CONDIMENT COMPARTMENT FOR QUICK SCOOP FOOD CARTONS

PRIOR ART

U.S. Pat. Nos. 3,630,430, 4,164,588, 4,185,764 and 4,267,955 all illustrate quick scoop cartons; however, none of these patents include a compartment mounted on the carton to hold condiments. Often, with prior art cartons, the user is required to squeeze the condiments out of a plastic packet directly on the food. This is typically a difficult and messy process, especially while riding as a passenger in a vehicle. Usually, the condiment is spread over the top of the food in the carton. An example is the spreading of ketchup from a plastic packet over the top of french fried potatoes. In doing this, there are two principal problems. The user must get rid of the plastic packet which typically has ketchup dripping from its open end. The user is then required to try to pick up the french fried potatoes from the carton which have just had ketchup poured all over them. This is often difficult to do without getting ketchup on the users fingers and often on the interior of the vehicle. There is a need for a simpler and neater method of dispensing condiments in such situations. Such a method is made possible by the condiment compartment of the present invention.

DETAILED DESCRIPTION OF THE INVENTION

Figure 2:
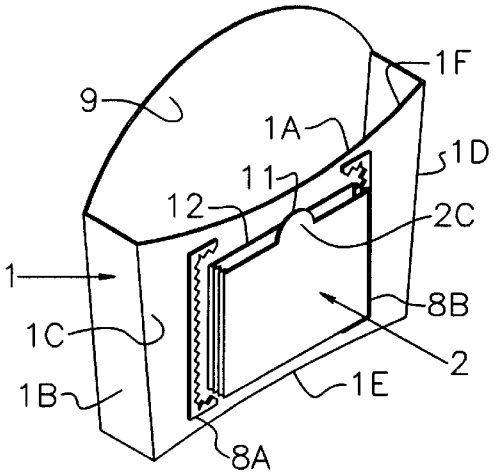
FIG. 2 shows a carton similar to that of FIG. 1, but with a condiment compartment mounted on the front panel of the carton.

To facilitate the description of the present invention, the quick scoop carton will be generally described in a position in which it is normally held by a consumer of the food in the carton, which is with the opening for the food being held at the top, the carton panel normally facing the consumer being designated as the front panel and the rear or scoop containing panel being referred to as the rear panel. This position is illustrated in FIG. 2 where the carton 1 includes the opening

1A, a left side panel 1B, a front panel 1C, a right side panel 1D, a bottom panel 1E, and a rear panel 9. The same orientation is generally true for the condiment compartment, which means the opening in the condiment compartment to accept condiments is held at the top. To further simplify the description, "quick scoop carton" may be used interchangeably with simply "carton", "condiment compartment" may be used interchangeably with simply "compartment", "panel of the carton" may be used interchangeable with "carton panel" and "panel of the compartment" may be used interchangeably with "compartment panel".

Figure 1:
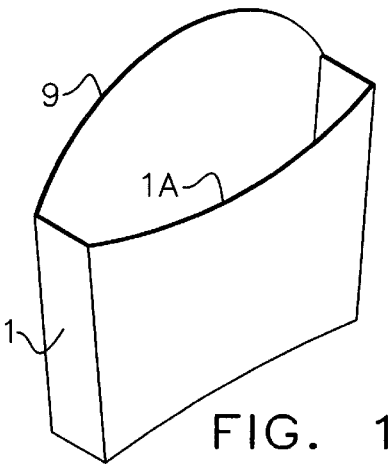
FIG. 1 is a drawing of a prior art quick scoop carton.

FIG. 1 shows a prior art quick scoop carton 1 without a condiment compartment, but with a high rear panel 9 which serves as the carton's "scoop" to pick up food quickly. Food is picked up by the scoop and fed into the carton through the opening 1A in the top of the carton. The principal difference between the prior art and the present invention is shown in FIG. 2. In FIG. 2, a first embodiment of the present invention is shown to include a condiment compartment, such as compartment 2, attached to a front panel 1C of a quick scoop carton 1. This location for the compartment leaves the high rear panel 9 free to act as a scoop because the compartment is located on the opposite side of the carton which is out of the way of the scoop. A condiment, such as ketchup, is poured into the condiment compartment through a top opening 12 prior to a road trip. The food, such as french fried potatoes, held in the quick scoop carton, is dipped into the condiment compartment to the depth desired by the user. There is no plastic package to squeeze while holding on to the quick scoop carton. To eat the french fried potatoes, the user simply continues to hold the end of the french fried potato that have not been covered with the condiment. As the french fries are consumed, they can be easily and conveniently redipped in the condiment as desired, a step that was not easily accomplished previously.

Figure 6B:
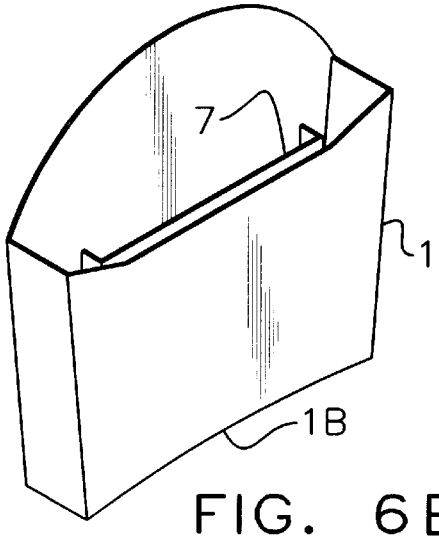
FIG. 6B is a quick scoop carton with the divider of FIG. 6A installed.

It should be noted that the condiment compartment may be attached to the outside of the carton's front panel or the outside of other carton panels. It may also be attached to the inside of the carton front panel or the inside of other panels within the carton. There are many possible configurations for the condiment compartment, one of which is shown in FIG. 6B where the compartment is located inside the carton. This compartment is designated by drawing number 7. It is possible to place the condiment compartment 2 shown in FIG. 2 within the carton in a manner similar to that shown in FIG. 6B. In that location inside the compartment, it is easier to ship and handle the cartons because the condiment compartment cannot interfere with anything that may come in contact with the outside of the carton. Alternatively, there are several ways of securing the condiment compartment to the outside of the carton which aid in overcoming possible interference during shipping.

Figure 3:
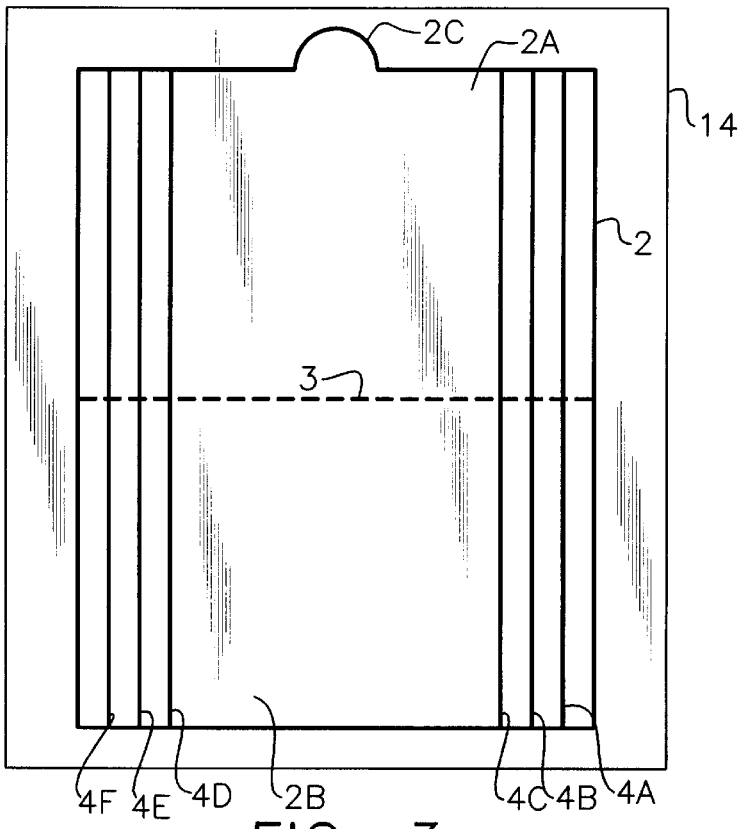
FIG. 3 is a plan view of a flat layout of the condiment compartment shown in FIG. 2.

The compartment may be made using the flat layout pattern shown in FIG. 3 in which a blank 2 is cut from a flat sheet of suitable stock material 14. The blank is the result of the cutting out of the stock material in a pattern which, when folded, forms the condiment compartment, or in the case of a carton blank, forms the carton. The blank of FIG. 3 can take on many shapes, but is typically rectangular as shown. This blank deviates from a rectangle only at its top where a lip 2C is located. In this Figure, lines are drawn on the blank where folds or cuts are to be made for the assembly of the compartment. A horizontal or lateral line 3 is drawn midway between the top and bottom of this blank. There are additional lines 4A through 4F drawn vertically on the blank. Lines 4A through 4C are drawn on the right side of the blank while lines 4D through 4F are drawn on the left side of the blank. Lines 4A through 4C and 4D through 4F each extend inwardly from the right and left edges respectively generally less than one-third the width of the blank. The blank is first folded vertically along lines 4A through 4F. These vertical folds are in alternate directions to make accordion-like areas that are to be converted to sides of the compartment. The blank is then folded approximately in half along line 3.

The folding of the compartment blank along line 3 forms the front of the compartment 2A and the rear of the compartment 2B. The folding along line 3 also forms the bottom of the condiment compartment. The adjacent folded accordion-like areas on the left side of the compartment are joined together at their left edges and they are also joined at their bottom edges to the carton bottom. Similar assembly steps are carried out for the accordion-like areas on the right side of the compartment to form a compartment that is sealed and leak proof. The stock material for this blank is typically a relatively heavy weight paper impregnated with a wax or another filter to prevent leakage of the food or condiment contents through the paper.

The compartment is then attached to the front of the carton, as shown in FIG. 2. The joining of the accordion-like areas and the attachment of the compartment to the carton is typically accomplished with an adhesive. It can be seen from this fabrication process that the accordion like side panels of the condiment compartment can be viewed as simply being right and left side extensions of the front and the rear panels of the condiment compartment.

Figure 2A:
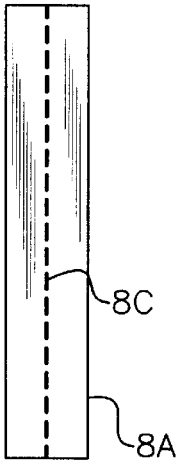
FIG. 2A shows a strip with perforations to permit sealing the condiment compartment for shipping purposes, while still providing for easy opening along the perforations for use.

The compartment front panel includes the lip 2C at its top to enable the user to easily open the compartment and hold it open while installing the condiment. To aid in shipping the cartons with the compartment attached, an adhesive is applied to a portion of the underside of lip 2C to hold the compartment closed against the front panel of the carton until it is desired to use the compartment. Alternatively, a first strip 8A and a second strip 8B which have a detachable adhesive on one side are placed along each side of the compartment 2 to hold the compartment closed during transportation, as shown in FIG. 2A. These strips overlap both the compartment and the carton. The strips 8A and 8B are shown partly broken away to reveal the details of the condiment compartment underneath these strips. The adhesive on these strips is referred to as detachable because it has only a medium attachment strength, enabling the strips to hold the compartment closed while being transported and yet remain sufficiently soft to enable the strips to be removed easily, without damage to either the compartment or carton, when the compartment is opened for use.

A variation of the strips 8A and 8B is shown in FIG. 2A. A perforation is made along a longitudinal line generally placed in the middle of the strips, such as line 8C made in strip 8A, as can be seen in this Figure. These strips are attached to the carton and the compartment with a more permanent adhesive than was used for the nonperforated strips because these strips are not removed. The perforation line is generally aligned with the edge of the compartment. Pulling on the compartment lip 2C will cause these strips to split along the perforation line, allowing the compartment to open by expanding outward from the carton into a position where the compartment is ready for use.

Figure 6A:
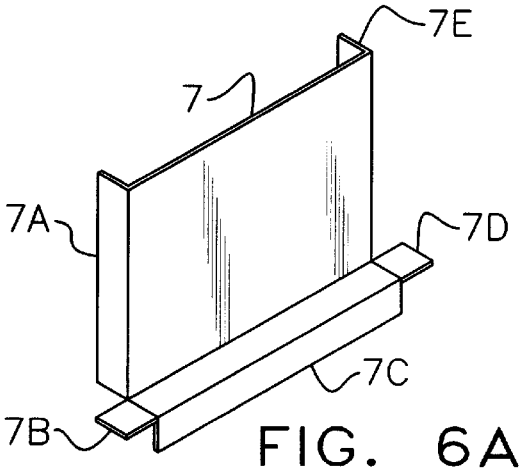
FIG. 6A is a short drawer type of divider made to fit into existing cartons to provide a condiment compartment.
Figure 6C:
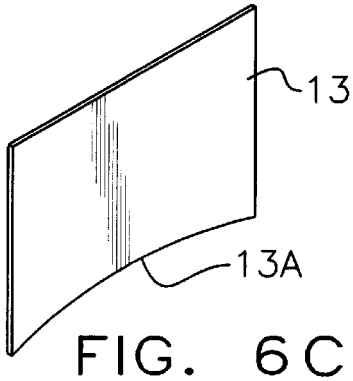
FIG. 6C is a card type divider which can also be placed in the carton of FIG. 6B to divide the carton into a condiment and a food compartment.

A second embodiment of the invention is shown in FIGS. 6A, 6B and 6C. A divider 7 is placed in the carton to divide the space normally used to hold the food into two areas, one for the food and the other for the condiments. In one variation of this embodiment shown in FIG. 6C, the divider is a card 13 that is a generally rectangular panel attached about its edges to the left, right, and bottom panels of the carton. When the carton has an arched bottom such as arch 1B shown in FIG. 6B, the divider card 13 may also have a matching arched bottom 13A, as shown in FIG. 6C. In another alternative, shown in FIG. 7A, the condiment compartment is made shallow by providing a divider 7 that is shorter than the carton height. This divider is designed to go down in the carton less than one half the depth of the carton. It is attached to the walls of the carton by a plurality of tabs, such as 7A through 7E, which are located about the edge of divider 7 and are secured to the inside of the carton by an adhesive which is applied to the surface of these tabs. The shallow depth of the condiment compartment provided by this divider serves to hold the condiment in a position that is readily accessible to the user.

Figure 4:
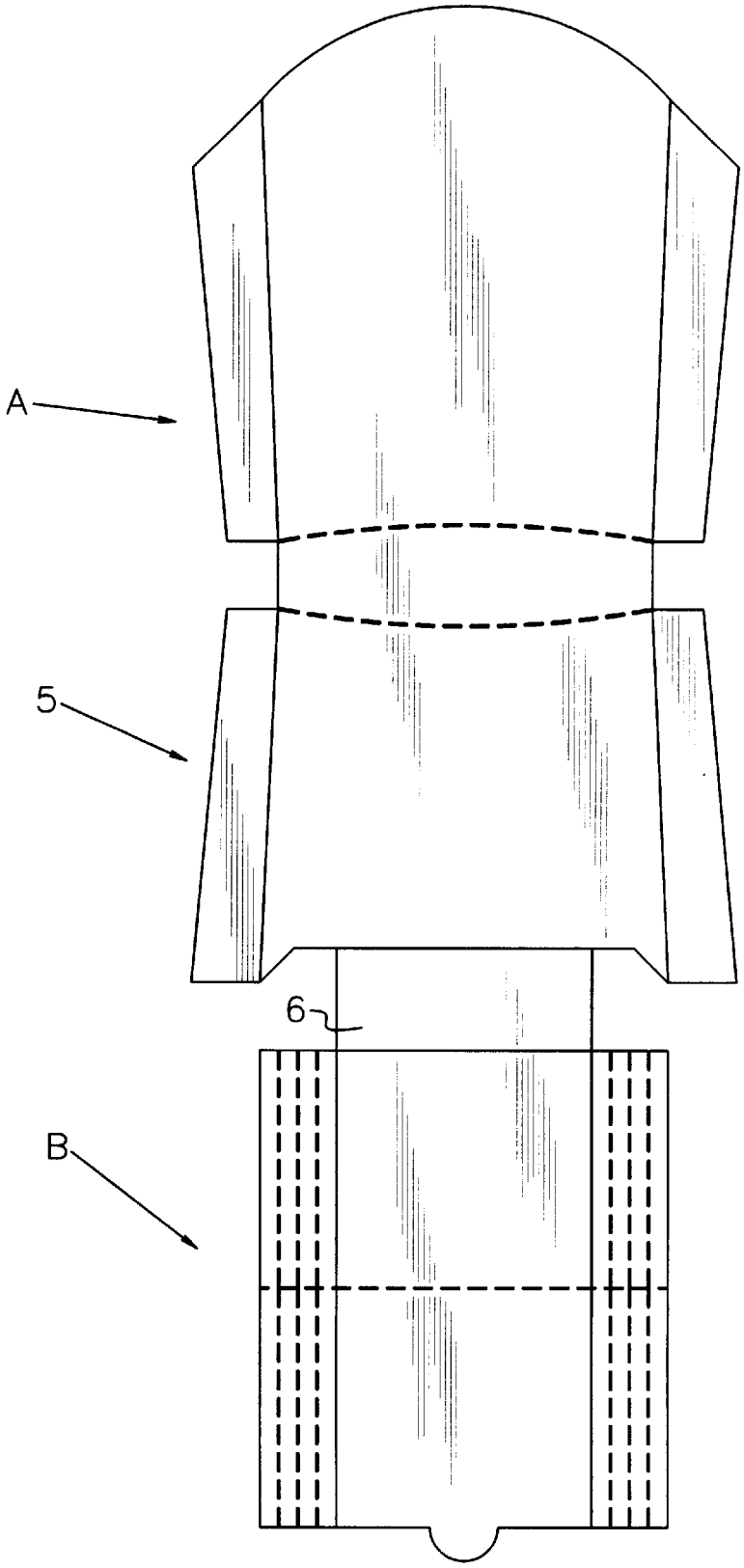
FIG. 4 is a plan view of a flat lay out showing a preferred embodiment of the present invention in which the condiment compartment and the scoop carton are cut out and assembled together.

A third embodiment of the present invention, shown in FIG. 4, facilitates the simultaneous fabrication of a quick scoop carton and an attached condiment compartment. In this Figure, the carton is shown as a blank 5 which has been cut from a flat sheet of stock material. This blank includes the carton A, shown in the upper portion of this Figure, and the condiment compartment B, shown in the lower portion of this Figure. Note that the carton A and the condiment compartment B are connected by a transitional section 6, making it possible to cut out the entire blank at one time from one sheet of stock material and then fold and form the entire assembly at one time. Although, it is not necessary to use an adhesive to secure the condiment compartment to the carton, because the transitional section performs that function, the addition of adhesive to the rear panel of the condiment compartment to provide an additional means of securing the compartment to the carton is preferred.

Figure 5:
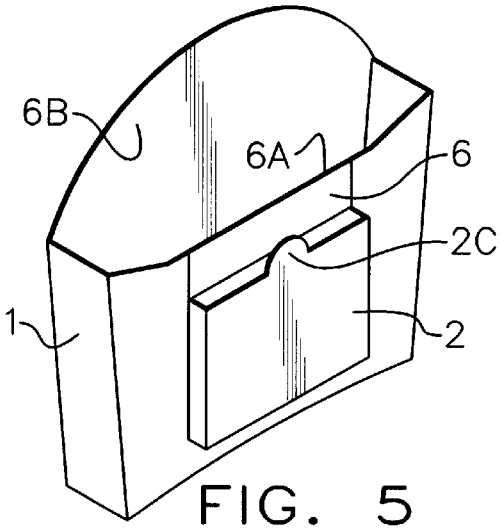
FIG. 5 is a quick scoop carton with a condiment compartment made from the layout of FIG. 4.

In the fabrication of the combined carton and condiment compartment shown in FIG. 4, all the components are held together from the initial step of the cutting out of the blank through final assembly. The condiment compartment 2 is not a separate part that has to be attached as shown in FIG. 2. As can be seen in FIG. 5, which shows the fully assembled "one piece" compartment and carton, the transitional section 6 is connected between the bottom edge 6A of the carton opening 6B and the condiment compartment 2. Note that the bottom edge of the opening 6A must follow a straight line contour rather than the curved line contour 1F shown in FIG. 2 to enable the transitional section 6 to be folded over and down on the front panel of the carton 1.

Figure 7A:
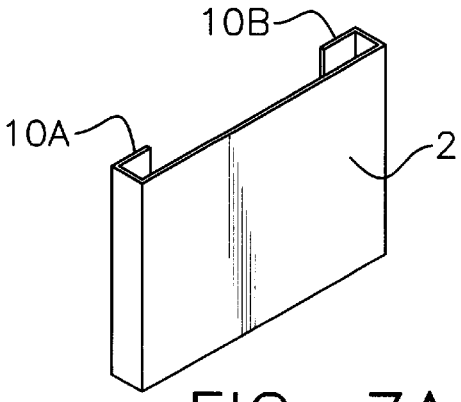
FIG. 7A is a front view of a compartment which avoids the need for a rear panel.
Figure 7B:
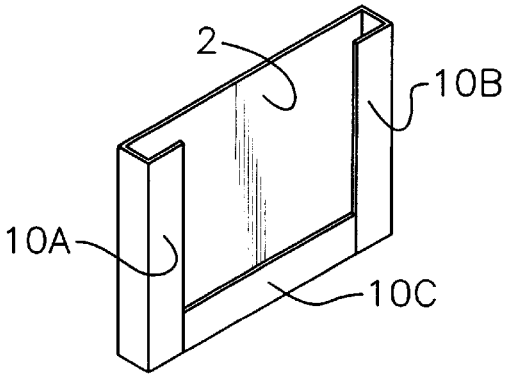
FIG. 7B is a rear view of the compartment shown in FIG. 7A.

A forth embodiment of the present invention is shown in FIGS. 7A and 7B. FIG. 7A shows the front view of a condiment compartment 2 which does not have a rear panel, but instead has rear tabs such as tabs 10A, 10B and 10C which are used to attach the compartment to the carton. As can be seen in FIG. 7B the tabs are placed on each side and at the bottom of where the rear panel would ordinarily be located. These tabs are secured to the front of a carton by applying adhesive to the tabs and pressing the compartment on to the carton. The advantage is in the simplicity of the design and the saving of material. An alternative of this design includes the accordion-like sides and the lip 2C shown in FIGS. 2 and 5.

It should be noted that the condiment compartment can be fabricated using a number of possible materials in addition to impregnated paper without departing from the spirit and scope of the invention. These materials include, but are not limited to, paper, foil, plastic or a combination of these materials, such as paper with a foil laminated on one side. This latter material is typically used to reduce the possibilities of leaks and retain the heat of foods placed within the carton.

Having described my invention, I claim:

1. A quick scoop carton comprising a top, sides, and a bottom with the top being positioned upwards, said sides being formed of a plurality of carton side panels and said carton side panels with said carton bottom together enclosing an inner space enabling said carton to hold food, and said carton including an opening at the top of said carton, opposite said carton bottom, to accept said food into said carton, said carton further comprising a condiment compartment which includes a top, sides, and a bottom with the the top of said compartment being positioned upwards, said compartment sides being formed of a plurality of compartment side panels and said compartment side panels with said compartment bottom together enclosing and holding said condiments, and said compartment including an opening at the top of said compartment opposite said compartment bottom, to accept condiments into said compartment, said compartment being attached to a side panel of said carton to conveniently position said condiments for application to said food, as said food is withdrawn from within said carton for consumption said side panels of said condiment compartment being three in number and being designated as the compartment front panel, left side panel, and right side panel, all of said compartment side panels having left, right and bottom edges with the left edge of the compartment front panel being connected to the right edge of the compartment left side panel and the right edge of the compartment front panel being connected to the left edge of the compartment right side panel said compartment bottom having four sides with three of the compartment bottom sides being connected to the bottom edges of said compartment front, right and left panels, said compartment front, left and right panels and said compartment bottom having tabs extending from the said edges of the compartment front, left side, and right side panels and the bottom that remain unconnected, said tabs being attached to a first one of said side panels of said carton to hold the compartment to the carton and to eliminating the need for a rear panel to the condiment compartment by using said first one of said side panels of the carton in place of a rear panel of the condiment compartment.

2. A quick scoop carton comprising a top, sides, and a bottom with the top being positioned upwards, said sides being formed of a plurality of carton side panels and said carton side panels with said carton bottom together enclosing an inner space enabling said carton to hold food, and said carton including an opening at the top of said carton, opposite said carton bottom, to accept said food into said carton, said carton further comprising a condiment compartment which includes a top, sides, and a bottom with the the top of said compartment being positioned upwards, said compartment sides being formed of a plurality of compartment side panels and said compartment side panels with said compartment bottom together enclosing and holding said condiments, and said compartment including an opening at the top of said compartment opposite said compartment bottom, to accept condiments into said compartment, said compartment being attached to a first side panel of said carton to conveniently position said condiments for application to said food, as said food is withdrawn from within said carton for consumption said condiment compartment includes a compartment front panel, rear panel, left side panel, right side panel and bottom, with said compartment front and rear panels each having a having a lower edge, said front and rear panel being joined together at their lower edges to form the compartment bottom, said left and right side panels of said compartment being formed of extensions to the left and right sides of the compartment front and rear panels, each extension having a lower edge, the extensions from the left side of said compartment front panel and the left side of said rear panel being joined to form said compartment left side panel and the extensions from the right side of the compartment front panel and right side of the compartment rear panel being joined to form the compartment right side panel, said compartment side panels being joined at their lower edges to said compartment bottom and said compartment side panels each containing at least one fold to allow said compartment to be closed with the compartment front panel being in close proximity to the compartment rear panel for shipping purposes and to allow said compartment to be opened with the compartment front panel being separated from the compartment rear panel to accept condiments.

3. A condiment compartment as claimed in claim 2, wherein said compartment is formed from a compartment blank cut from a single sheet of stock material and said compartment bottom is produced by folding said blank along a lateral line that generally lies midway between the compartment front and rear panels on said compartment blank.

4. A quick scoop carton which includes a condiment compartment as claimed in claim 2 further comprising a lip located on the top edge of said compartment front panel, said lip being formed of an upward projection of the top edge of the compartment front panel, and said lip projecting above the other adjacent panels of the compartment to enabling the lip to be easily grasped to open said condiment compartment.

5. A quick scoop carton which includes a condiment compartment as claimed in claim 4 further comprising a soft adhesive placed on the side of the lip facing the carton to enable said lip to be secured by means of said adhesive to the carton for shipping and handling purposes and then to permit said lip to be withdrawn from said carton to open said condiment compartment for insertion of condiments.

6. A quick scoop carton which includes a condiment compartment as claimed in claim 2 further comprising a first and a second adhesive strip with adhesive being contained only on one surface of said strips, each strip having a length greater than its width, with the longer direction across the strip being referred to as the longitudinal direction, said first adhesive strip being applied to the left side of the front panel of said compartment with the adhesive surface of the strip facing the compartment front panel and a portion of said first adhesive strip extending to overlap the carton front panel, and the second adhesive strip being applied to the right side of said compartment front panel with the adhesive surface facing said compartment front panel, and a portion of said second adhesive strip extending to overlap said first panel of the quick scoop carton to hold said condiment compartment closed during transport and handling with the compartment front panel being placed in close proximity to the compartment rear panel, said adhesive strips containing a soft adhesive which is easily disengaged to enable the compartment to be open when desired to accept condiments.

7. A method for producing a condiment compartment for use with a quick scoop carton, comprising the steps of:

(a) providing a single flat sheet of stock material, said stock material being suitable for holding food and condiments, (b) cutting from said flat sheet of stock material a generally rectangular compartment blank which is contoured to be folded generally in one-half after cutting to produce said condiment compartment, said compartment blank having principally four edges made up of a first and a second set with each set comprising two edges each, the edges in each set being positioned generally opposite one another in the first set one edge is designated the top edge, while the second edge is designated the bottom edge in the second set, one edge is designated the left side edge while the second edge is designated the right side edge in the second set of edges one edge is designated the left side and the other edge is designated the right side the top, lower, left and right edges, with the top and lower edges being located opposite one another and the left and right edges being located opposite one another, (c) folding a portion of the left and right sides of said blank in alternate directions, each of said folded portions measuring before folding less than one third the width of the blank from the left to the right side, with the folds being generally in the vertical direction to convert said portions into two accordion-like sections with the first accordion-like section being located on the left side of said blank and the second of said accordion-like sections being located on the right side of said blank, (d) folding said blank along a lateral line running from the left to right edge of said blank, said lateral line being located generally midway between said top and lower edge of said blank, the folding of the blank along said lateral line creating two panels with one being designated the front and other being designated the rear panel for said compartment and also said folding along said lateral line creating four accordion like areas from the the two accordion-like sections, said four accordion like areas being designed to be converted into compartment side panels, the first and second of said areas being located on the left sides of said front and rear panels of said compartment respectively and the third and forth accordion like areas being located on the right sides of said front and rear panels of said compartment respectively, the first and second accordion-like areas being located on the left of said compartment immediately adjacent one another and the third and forth accordion like areas being located on the right of said compartment and immediately adjacent one another, said folding of said blank along said lateral line also forming the compartment bottom, which lies along said lateral line, and (e) joining each of the two accordion like areas on the compartment left side together and joining the two accordion-like areas on the compartment right side together to form the compartment left and right side panels, respectively, and further joining said compartment left and right side panels to said compartment bottom to provide an enclosed space to hold said condiments.

8. A method as claimed in claim 7, further comprising the steps of:

(a) cutting from a single flat sheet of stock material a quick scoop carton blank, and a container blank, and (b) cutting from said single flat sheet of stock material a transition section having generally four sides, said transition section being connected on one side to said quick scoop carton and on another side to said condiment compartment.

* * * * *